US006339435B1

(12) United States Patent
Kim

(10) Patent No.: US 6,339,435 B1
(45) Date of Patent: Jan. 15, 2002

(54) DEVICE TO AUTOMATICALLY ADJUST VIDEO SIGNALS TO A BLANKING LEVEL AND METHOD THEREFOR

(75) Inventor: Young-chan Kim, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/220,778

(22) Filed: Dec. 28, 1998

(30) Foreign Application Priority Data

Dec. 26, 1997 (KR) ..... 97-74267

(51) Int. Cl.[7] ..... G09G 5/10

(52) U.S. Cl. ..... 345/690; 345/691; 345/694; 345/698; 348/694; 348/695; 348/696; 348/697

(58) Field of Search ..... 345/147, 148, 345/149, 150, 151, 152, 153, 154, 155, 690, 691, 694, 698; 348/695, 696, 697, 694

(56) References Cited

U.S. PATENT DOCUMENTS 3,909,521 A * 9/1975 Hunt et al. ..... 178/7.2
5,270,687 A * 12/1993 Kilebrew, Jr. ..... 345/150
5,400,057 A * 3/1995 Yin ..... 345/199
5,644,325 A * 7/1997 King et al. ..... 345/20

* cited by examiner

*Primary Examiner*—Richard Hjerpe
*Assistant Examiner*—Jean Lesperance
(74) *Attorney, Agent, or Firm*—Staas & Halsey LLP

(57) ABSTRACT

A device to automatically adjust video signals to a blanking level to realize a precise intended color by being fed back with video signals at the blanking level stored in an ASIC (application-specific integrated circuit), which stores video signals at a blanking level received in a flat display panel, and by generating clamp signals so as to realize a blanking level precisely, and a method therefor.

9 Claims, 2 Drawing Sheets

17
FLAT PANEL
14b
SECOND PLL
14a
FIRST PLL
CLOCK
CLOCK
CLOCK
R
G
B
H_FREQ
V_FREQ
16
ASIC
12V
9V
OSD_R
OSD_G
OSD_B
18
OSD IC
15
ADC
R
G
B
13
PRE-AMPLIFIER
CONTROL 2
12
MCU
PLL 2 CONTROL
PLL 1 CONTROL
ASIC CONTROL
CONTROL 1
H_FREQ
V_FREQ
OSD_CONTROL
n
11
D-SUB
19
SMPS

DEVICE TO AUTOMATICALLY ADJUST VIDEO SIGNALS TO A BLANKING LEVEL AND METHOD THEREFOR

CROSS REFERENCE TO RELATED APPLICATIONS

This application makes reference to, incorporates the same herein, and claims all benefits accruing under 35 U.S.C. §119 from my application entitled Automatically Blanking Level of Video Signal Controlling Device and Controlling Method filed with the Korean Industrial Property Office on Dec. 26, 1997 and there duly assigned Serial No. 97-74267 by that Office.

BACKGROUND OF THE INVENTION

1. Field of the Invention

The present invention relates to a device to automatically adjust video signals to a blanking level and method therefor, and more particularly, to a device to automatically adjust video signals to a blanking level for accurately realizing an intended color by feeding back video signals at the blanking level stored in an Application Specific Integrated Circuit (ASIC), which stores video signals at the blanking level received in a flat display, and by generating clamp signals for accurately realizing a blanking level, and a method therefor.

2. Discussion of the Related Art

A plasma display (abbreviated to PDP hereafter), a liquid crystal display (abbreviated to LCD hereafter), and a light emitting display (abbreviated to LED hereafter), etc., are different types of flat displays. Video signals generated from a host, and horizontal and vertical synchronizing signals for synchronizing the video signals are transmitted to the PDP, e.g., and video signals are synchronized and represented in accordance with the received horizontal and vertical synchronizing signals. Video signals received by clamp signals generated from a micro-processor unit (abbreviated to MCU hereafter) are blanked, for blanking represented video signals, and represented.

Clamp signals generated from an MCU are adjusted at the time flat displays are produced. There is a case where the flat display is not able to correctly handle image signals of a pre-amplifier and an analog to digital convertor (abbreviated to ADC hereafter) when video signals are at the blanking level. That is, there is a case when video signals at a blanking level are not handled normally in the process of amplifying and outputting video signals at a blanking level as a transistor-transistor logic (abbreviated to TTL hereafter) level in the pre-amp, and in the process of sampling and outputting as digital signals in the ADC. In order to correct this, after the clamp signals generated from the MCU have been adjusted, the goods come to be forwarded.

For this reason, complexity of a manufacturing process increases and video signals cannot be easily adjusted to a blanking level because the clamp level of video signals is adjusted in the manufacturing process of the flat display, and so it is impossible to realize a precise color.

SUMMARY OF THE INVENTION

Accordingly, in order to overcome such drawbacks in the conventional art, it is therefore an object of the present invention to provide a device to automatically adjust video signals to a blanking level to realize a more precise color by a micro-processor unit (MCU) being fed back with video signals at the blanking level stored in the ASIC, which samples video signals at the blanking level received in a flat display and stores video signals converted into digital signals, and by generating clamp signals to adjust the video signals to a blanking level automatically, and method therefor.

Additional objects and advantages of the invention will be set forth in part in the description which follows and, in part, will be obvious from the description, or may be learned by practice of the invention.

To achieve these and other advantages and in accordance with the purpose of the present invention, as embodied and broadly described, there is provided a device to automatically adjust video signals to a blanking level, the device including: an ASIC (application-specific integrated circuit) to store blank video signals to be sampled and output as digital signals by an ADC (analog-digital converter), and to output a first control signal in accordance with the stored digital blank video signals; and the MCU to transmit a second control signal to a pre-amp, the second control signal blanking non-blanked portions in the first control signal received from the ASIC.

According to another aspect of the present invention, there is also provided a method for automatically adjusting video signals to a blanking level, the method including: checking the presence or the absence of video signals not at the blanking level according to a first control signals; and adjusting video signal not at the blanking level into video signals at the blanking level by generating a second control signal in the case of the presence of video signals not at the blanking level in the checking step.

BRIEF DESCRIPTION OF THE DRAWINGS

These and other objects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
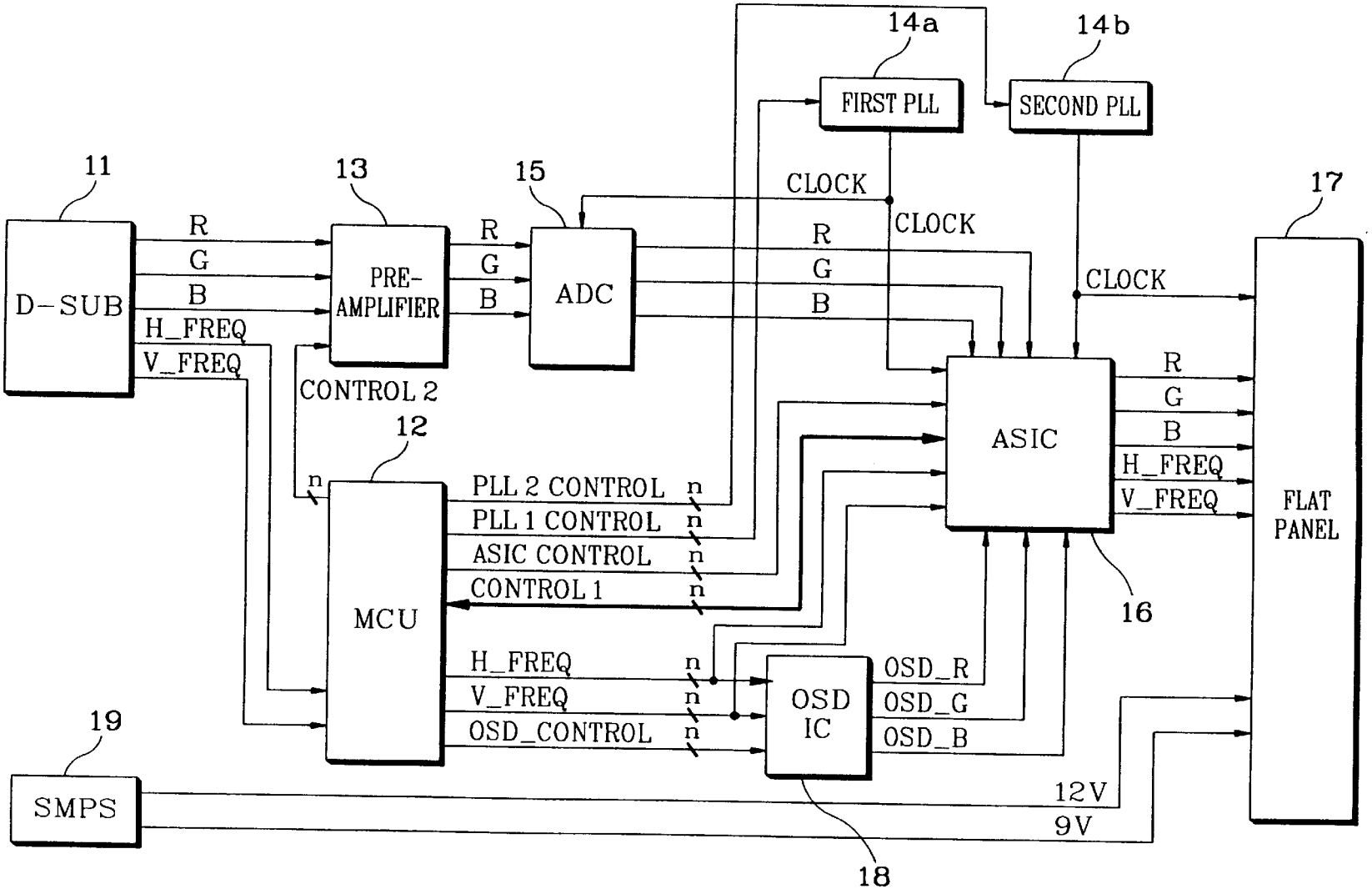
FIG. 1 is a block view illustrating the constitution of the inner circuit of a flat display having a device to automatically adjust a video signal to a blanking level according to an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

As shown in FIG. 1, a device to automatically adjust video signals to a blanking level according to an embodiment of the present invention comprises an ASIC 16 storing video signals sampled to digital signals and an MCU 12 being fed back a first control signal when video signals stored in the ASIC 16 are at a blanking level, and generating and outputting a second control signal to adjust the blanking level, and a pre-amplifier 13 receiving the second control signal output from the MCU 12, receiving video signals (R, G, B) at the blanking level transmitted from a D-shaped connector (D-SUB) 11, and amplifying and outputting the received video signals (R, G, B) at the blanking level according to the received second control signal, to a TTL level.

Figure 2:
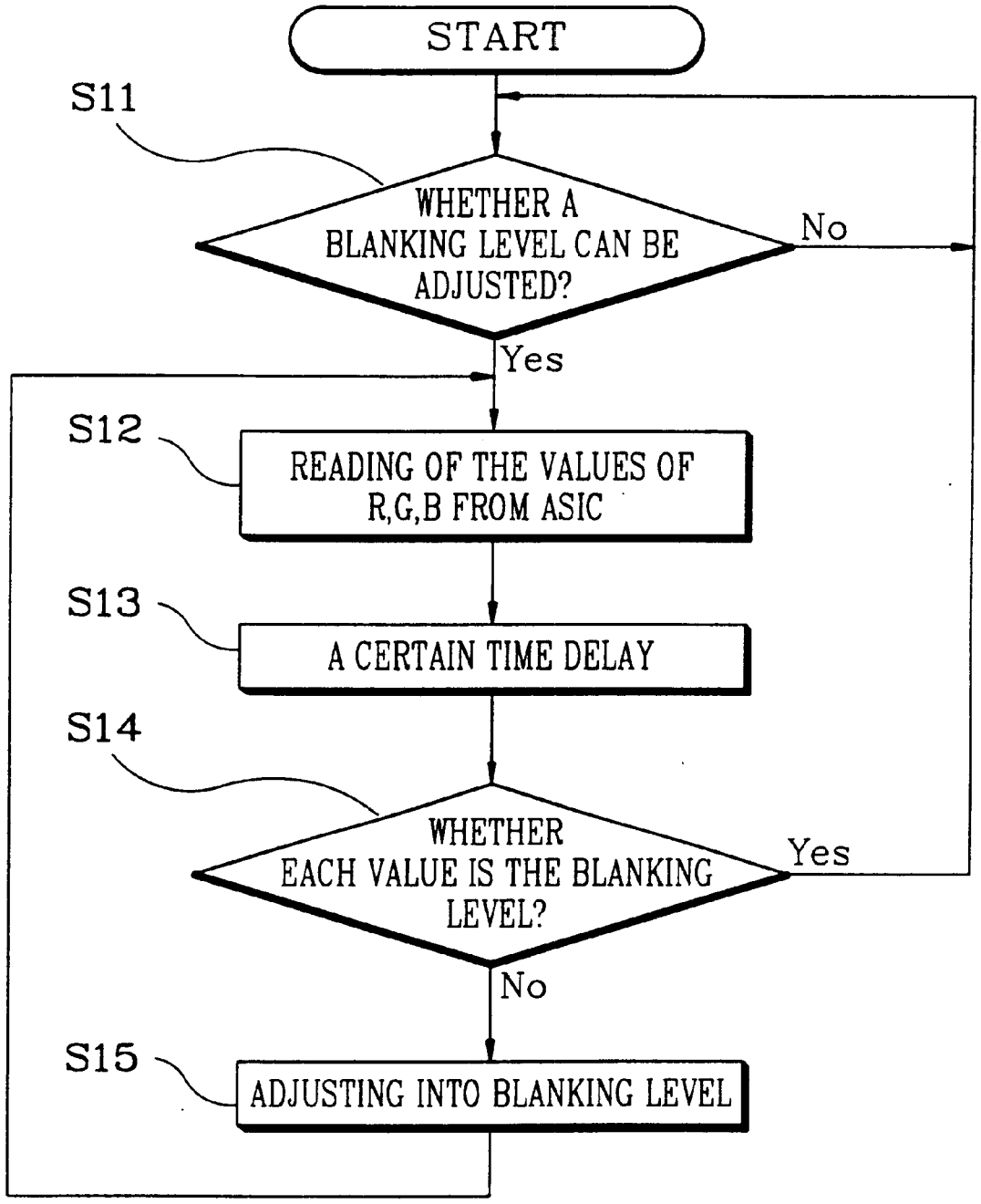
FIG. 2 is a flow view illustrating a method to automatically adjust video signals to a blanking level according to an embodiment of the present invention.

A method of controlling a device to automatically adjust the video signals to the blanking level above, as shown in FIG. 2, comprises a step (S11) of checking whether the blanking level can be adjusted and a step (S12) of reading level values of video signals (R, G, B) from the ASIC 16 if the blanking level can be adjusted in the checking step (S11), a step (S13) of delaying a predetermined time so as to be fed back with the first control signal according to the video signals at the blanking level in the reading step (S12), a step (S14) of checking whether there are video signals not at the blanking level according to the first control signal fed back after delaying for a predetermined time in the delaying step (S13), a step (S15) of converting non-blanked video signals (R,G,B) into the blanking level by generating the second control signal if there are video signals not at the blanking level in the checking step (S14).

This invention will be described in more detail as follows.

A flat panel 17 ultimately receives video signals (R, G, B), originally generated from a host, and the horizontal and vertical synchronizing signals from the D-shaped connector 11. To accomplish this, let us assume that the received video signals (R, G, B) are video signals (R, G, B) at the blanking level. In order to check that the video signals (R, G, B) are at the blanking level, pre-set conditions should be checked in the MCU 12 (S11). That is, the MCU 12, pre-set by a control knob (not illustrated), can perceive and check whether the video signals (R, G, B) are at the blanking level. When the video signals (R, G, B) at the blanking level are received, the pre-set conditions become activated and the MCU 12 perceives that the video signals (R, G, B) presently being received are at the blanking level. When the video signals (R, G, B) are not at the blanking level, the MCU 12 is operated again to check the whether the next video signals (R, G, B) are at the blanking level. The video signals (R, G, B) at the blanking level are sent from the D-shaped connector 11 to the pre-amplifier 13, amplified to the TTL level in the pre-amplifier 13 according to the second control signal and output as signals having a TTL level to an ADC 15. These video signals are output as digital video signals (R, G, B) after being sampled according to a clock sent to the ADC 15 and output from a first phase-locked loop (abbreviated to PLL here after) 14a. The second control signal sent to the preamplifier 13 are output from the MCU 12. The MCU 12 outputs the second control signal as well as a number of other control signals (PLL1 CONTROL, PLL2 CONTROL, ASIC CONTROL, OSD-CONTROL). The PLL1 control and the PLL2 control adjust clock cycles by locking in the clocks output from a first PLL 14*a* and a second PLL 14*b*, respectively. The other control signals (ASIC CONTROL, OSD-CONTROL, or, on screen display-control) are transmitted to the ASIC 16 and an OSD IC 18 (on screen display integrated circuit), respectively. The ASIC 16, having received the transmitted ASIC CONTROL, stores the digital signals (R, G, B) output from the ADC 15 according to the received signal ASIC CONTROL, and adjusts to output colors of the stored video signals (R, G, B) and images thereof. The video signals (R, G, B) in the ASIC 16 are stored and output according to the cycle of clocks output from the first PLL 14*a* and the second PLL 14*b*.

The MCU 12 reads the first control signal according to the digital video signals (R, G, B) at the blanking level stored in the ASIC 16 (S12). While the MCU 12 reads the video signals (R, G, B) stored in the ASIC 16, a certain time delay occurs (S13). When the video signals (R, G, B) are read after that certain time delay, the MCU 12 reads the first control signal and checks which of the signals (R, G, B) is not at the blanking level (S14). When all of the signals are at the blanking level after checking, the MCU 12 checks again whether the next video signals (R, G, B) are at the blanking level. On the contrary, when not all of the signals are at the blanking level, the MCU 12 outputs the second control signal having adjusted a clamp level to correct this (S15). The second control signal is transmitted to the pre-amplifier 13. The pre-amplifier 13, having received the second control signal, adjusts the blanking level according to the received second control signal and amplifies the video signals (R, G, B) to be output as a TTL level.

The video signals (R, G, B) at the output blanking level are stored in the ASIC 16 after being converted into digital video signals (R, G, B) by the ADC 15. The digital video signals (R, G, B) stored in the ASIC 16 are transmitted to the flat panel 17. The flat panel 17, which receives the digital video signals (R, G, B) stored in the ASIC 16, receives a driving power (9V, 12V) from an SMPS (Switching mode power supply) 19. That is, the video signals (R, G, B), the blanking level of which is automatically adjusted, are displayed on the flat panel 17. The next video signals (R, G, B), at the next blanking level, after automatically adjusting the blanking level of the current video signals (R,G,B) and displaying the same, are also adjusted and displayed according to the same process.

As described above, the present invention can reduce the process of adjusting video signals to a blanking level in manufacturing the flat panel. As a result, productivity can be improved. In addition, as the present invention automatically adjusts to the blanking level accurately, precise colors can be realized.

Although a preferred embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A device to automatically adjust video signals to a blanking level, comprising:

a pre-amplifier to amplify the video signals;

an analog-digital converter to convert the amplified video signals from said pre-amplifier to digital video signals;

an application-specific integrated circuit which stores the digital video signals as blank video signals and outputs a first control signal in accordance with the stored blank video signals; and a micro-processor unit which transmits a second control signal to said preamplifier, the second control signal blanking non-blanked portions in the first control signal received from said application-specific integrated circuit.

2. A method of automatically adjusting video signals to a blanking level, said method comprising:

checking a presence or an absence of video signals not converted into the blanking level according to a first control signal; and adjusting the video signals not converted into the blanking level by generating a second control signal blanking non-blanked portions in the first control signal in case of the presence of the video signals not converted into the blanking level in said checking of the presence or the absence of the video signals.

3. The method as claimed in claim 2, wherein said checking comprising delaying a predetermined time so as to receive the first control signal according to the video signals of the blanking level if the blanking level is adjustable.

4. The method as claimed in claim 3, wherein said delaying of the predetermined time comprises checking whether the blanking level is adjustable.

5. A device automatically adjusting video signals to a blanking level, comprising:

an integrated circuit storing the video signals as blank video signals and outputting a first control signal in accordance with the stored blank video signals; and a micro-processor unit being fed back the first control signal from said integrated circuit in response to the video signals stored in said integrated circuit being at the blanking level and outputting a second control signal to adjust the video signals to the blanking level in response to the video signals not being at the blanking level.

6. The device as claimed in claim 5, further comprising a control knob to pre-set said micro-processor unit to determine whether the video signals are at the blanking level.

7. The device as claimed in claim 5, wherein said micro-processor unit adjusts a clamp level to place the video signals at the blanking level.

8. The device as claimed in claim 5, further comprising:

a pre-amplifier receiving and amplifying the video signals at the blanking level according to the second control signal, said pre-amplifier outputting the video signals as having a transistor-transistor logic level; and an analog to digital converter converting the video signals to the digital video signals and outputting the digital video signals to the integrated circuit.

9. A method of automatically adjusting video signals to a blanking level, said method comprising:

checking whether the blanking level of the video signals is adjustable;

reading level values of the video signals if the blanking level is adjustable;

feeding back a first control signal according to the video signals at the blanking level in the reading of the level values of the video signals after delaying a predetermined time;

checking whether there are video signals not being converted into the blanking level according to the first control signal after delaying for the predetermined time in the feeding back of the first control signal; and converting non-blanked video signals into the blanking level by generating a second control signal if there are video signals not being converted into the blanking level in the checking of the video signals.

* * * * *